US006338173B1

(12) United States Patent
Ramsey

(10) Patent No.: US 6,338,173 B1
(45) Date of Patent: Jan. 15, 2002

(54) SLEEPING BAG WITH CHANGEABLE PARTS

(76) Inventor: Carson A. Ramsey, 19213 Blount Rd., Lutz, FL (US) 33549

( * ) Notice: Subject to any disclaimer, the term of this patent is extended or adjusted under 35 U.S.C. 154(b) by 0 days.

(21) Appl. No.: 09/626,201

(22) Filed: Jul. 26, 2000

(51) Int. Cl.[7] ..... A47G 9/08
(52) U.S. Cl. ..... 5/413 R; 5/485
(58) Field of Search ..... 5/413 R, 413 AM, 5/482, 485, 420; 2/69, 69.5

(56) References Cited

U.S. PATENT DOCUMENTS

| | | | | |
|---|---|---|---|---|
| 3,175,231 A | * | 3/1965 | Magario et al. | 5/413 R |
| 3,178,734 A | | 4/1965 | Carrez | 5/413 R |
| 3,584,323 A | | 6/1971 | Worley | 5/413 R |
| 4,513,461 A | | 4/1985 | Tardivel | 5/413 |
| 5,005,235 A | | 4/1991 | Huang | 5/413 |
| 5,193,235 A | | 3/1993 | Kircher | 5/413 |
| 5,343,578 A | | 9/1994 | Kettenhofen | 5/413 |
| 5,471,687 A | * | 12/1995 | Vierra | 5/413 AM |
| 5,533,216 A | | 7/1996 | Thier | 5/413 |
| 5,706,532 A | | 1/1998 | Kettenhofen | 5/413 |
| 5,966,756 A | | 10/1999 | Cartier | 5/413 |

* cited by examiner

*Primary Examiner*—Alexander Grosz
(74) *Attorney, Agent, or Firm*—Pettis & Van Royen, P.A.

(57) ABSTRACT

This invention relates to sleeping bags, more particularly to sleeping bags whose outer shell, liner, and insulation characteristics may be varied through selection of various combinations that are particularly suitable for the planned usage. The sleeping bag of this invention comprises a case constructed from two panels whose sides and one pair of ends are attached to one another and the other pair of ends define an opening into the space between the panels. The sleeping bag further comprises an insulation layer that is sized and configured to be easily removable and replaceable through the opening in the case. At least one fastener attaches the insulating layer to the case. Insulation layers having different thermal ratings may be substituted as needed to obtain adequate protection under varying weather conditions. Being removable from the insulation layer, the case may be cleaned and/or aired separately therefrom. The inner panel includes a closeable opening proximal the longitudinal centerline thereof, to permit easier placement and removal of the insulating layer between the two panels.

6 Claims, 6 Drawing Sheets

SLEEPING BAG WITH CHANGEABLE PARTS

BACKGROUND OF THE INVENTION

1. Field of the Invention

This invention relates to sleeping bags, more particularly to sleeping bags having insulation that can readily be removed and replaced with insulation having a different insulation factor.

2. Description of the Prior Art

Conventional sleeping bags consist basically of an outer shell, an inner liner and a layer of insulation. The outer shell and liner are sewn together to form a case and insulation is inserted between the outer shell and the liner before the case is stitched closed. The insulation is then sewn in place to prevent the insulation from migrating. The case then may be folded over upon itself so that its opposing edges are aligned. A zipper or other attaching means is attached along the bottom and the longitudinal sides of the case to open and close the sleeping bag.

The conventional sleeping bag must be purchased as a unit, leaving little option to the user as to the types of material, the amount of insulation or the color. When the shell or inner lining of a conventional sleeping bag is damaged, the whole sleeping bag frequently must be replaced. When one portion of the sleeping bag becomes soiled, the whole sleeping bag must be cleaned even though the insulation layer may be soiled far less than the shell or the inner liner.

Notwithstanding the existence of such prior art sleeping bags, it remains clear that to be able to easily disassemble the sleeping bag into its component parts (shell, inner liner and insulation layer) would enable the user to clean only the soiled part and having these component parts marketed separately would permit the user to replace only the damaged component. There is also a need for easy access to the insulation layer for ease of removal and a need for a means for maintaining the insulation layer properly aligned within the case.

SUMMARY OF THE INVENTION

The current invention relates to a sleeping bag having an easily removable insulation layer so that insulation layers having different thermal ratings may be substituted as needed to obtain adequate protection under varying weather conditions. The case of the sleeping bag is soiled more easily than the insulation layer and must be cleaned frequently. The case being easily removable from the insulation layer, permits the case to be cleaned as needed without overwashing the insulation layer.

The sleeping bag comprises a case constructed of a first panel that has opposing longitudinal sides, a first end and a second end and a second panel also having opposing longitudinal sides, a first end and a second end. The longitudinal sides of the first panel are attached to the juxtaposed longitudinal sides of the second panel and the second end of the first panel is attached to the second end of the second panel, defining a case and creating a compartment between the first panel and the second panel. The first ends of the first and second panels define an opening into the compartment. The attached longitudinal sides of the first panel and the second panel define a first side and a second side of the case, the first ends of the first and second panels define the first end of the case and the attached second ends of the first panel and the second panel define the second end of the case.

An insulating layer, having a predetermined insulation factor, is inserted through the opening into the compartment defined between the first panel and the second panel. At least one fastener attaches the insulating layer to the case to restrict movement of the insulating layer within the case.

The case is folded upon itself along the longitudinal center line of the case so that the first side of the case is adjacent to the second side of the case. When the case is folded the second end of the case is folded upon itself so that a first portion of the second end of the case is juxtaposed to a second portion of the second end of the case. The longitudinal sides of the case are releasably attachable to one another and the two portions of the second end of the case are releasably attachable to one another.

The invention accordingly comprises an article of manufacturer possessing the features, properties, and the relation to elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings. The same parts of different embodiments are identified in increments of 100.

DESCRIPTION OF THE PREFERRED EMBODIMENT

Figure 1:
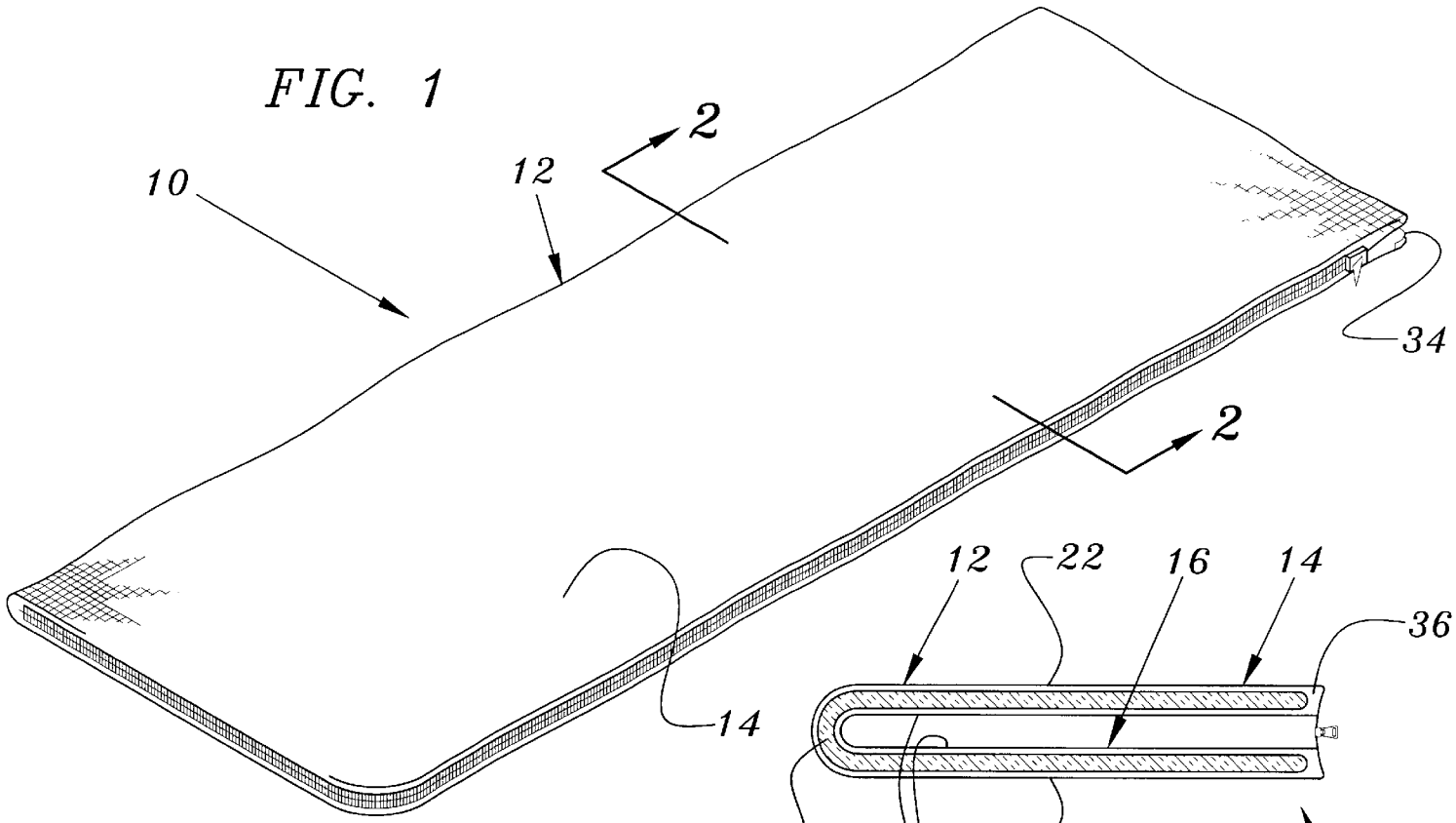
FIG. 1 is an isometric view of the sleeping bag of this invention.
Figure 2:
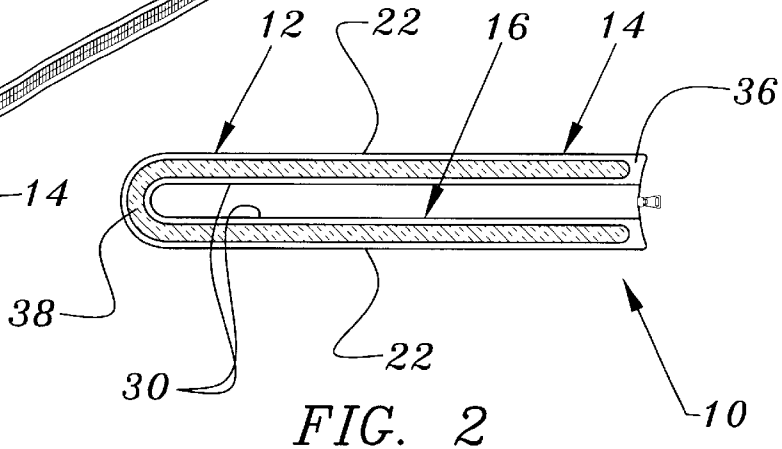
FIG. 2 is a cross-sectional view of the sleeping bag of this invention taken along line 2—2 of FIG. 1.
Figure 3:
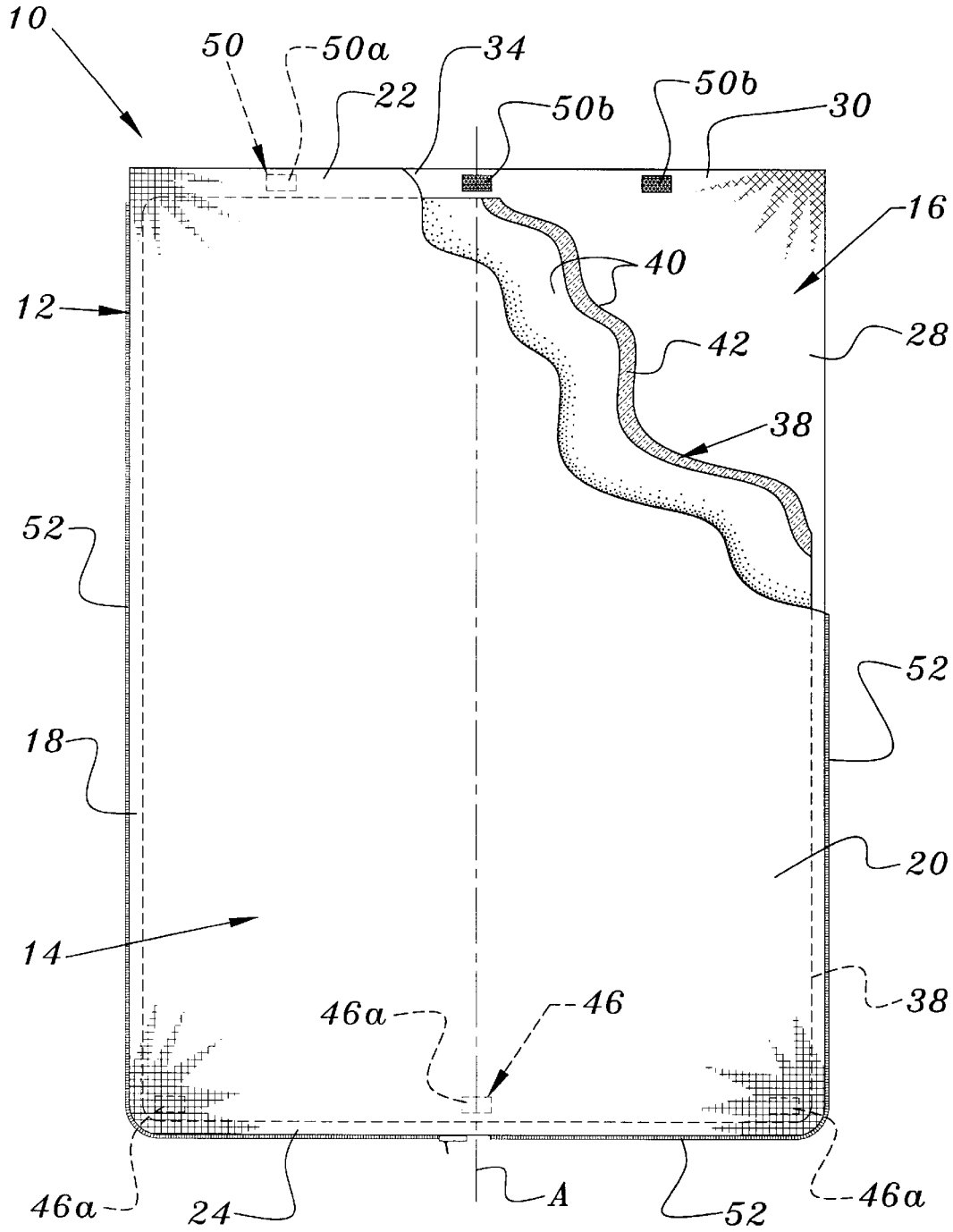
FIG. 3 is an unfolded bottom plan view of the sleeping bag of FIG. 1, with portions broken away to illustrate the juxtaposition of the first panel, the insulation layer, and the second panel.

A preferred embodiment for the sleeping bag of this invention is illustrated in the drawing FIGS. 1–4 in which the apparatus is generally indicated as 10. As seen in FIG. 1, the apparatus 10 is comprised of a case, shown generally as 12, and as shown in FIG. 2 and 3, an insulation layer shown generally as 38.

Figure 4:
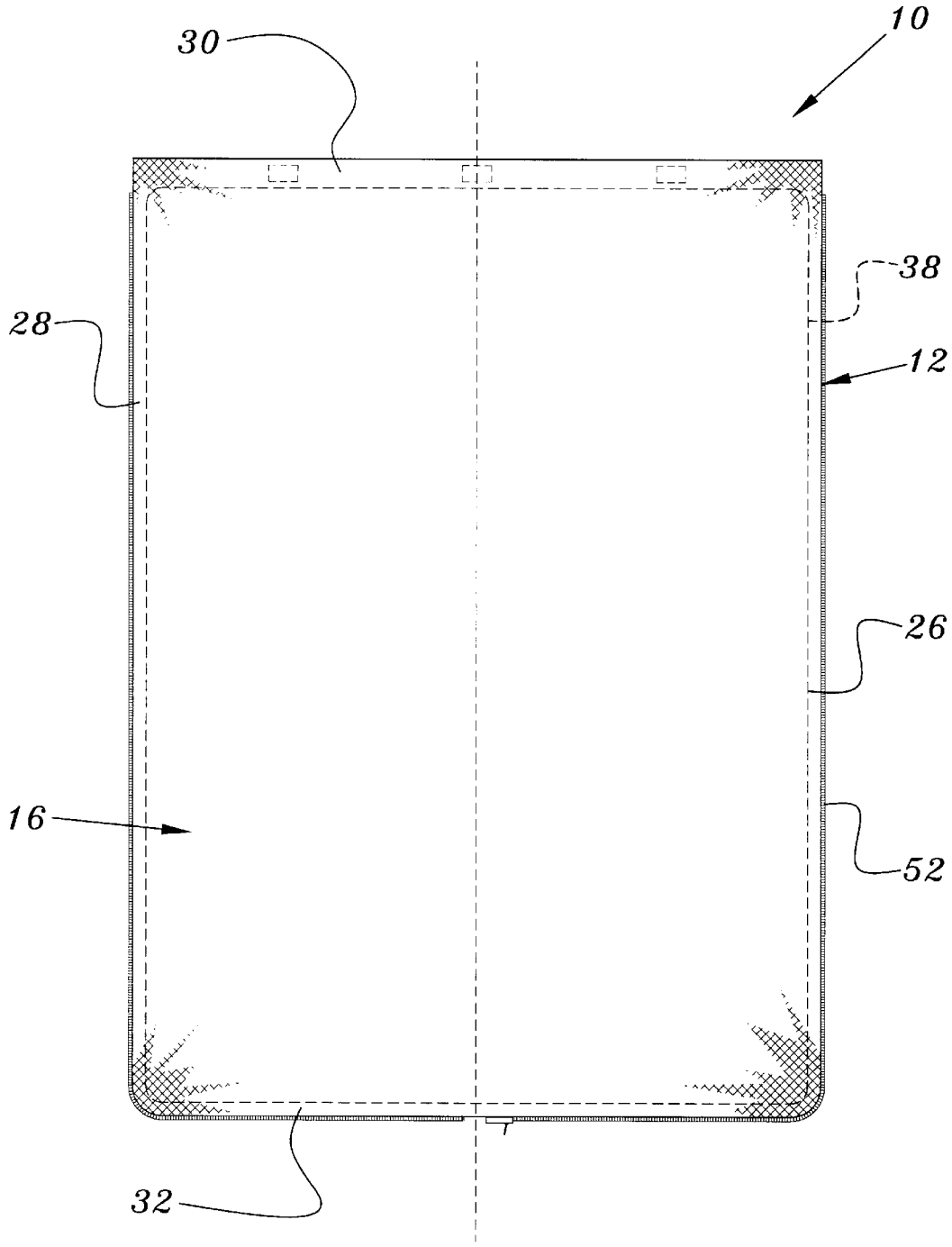
FIG. 4 is an unfolded top plan view of the sleeping that of FIG. 1.

As seen in FIG. 3, case 12 comprises a first panel 14 and a second panel 16. The first panel 14 has a pair of longitudinally extending sides 18 and 20, a first end 22 and a second end 24. The second panel 16, as seen in FIG. 4,also comprises a pair of longitudinally extending sides 26 and 28, a first end 30 and a second end 32. As clearly seen in FIG. 2, the first panel 14 is juxtaposed to the second panel 16, so that the longitudinal sides of the first panel are adjacent to the corresponding longitudinal sides of the second panel and the first end 24 of the first panel 14 is adjacent to the first end 30 of the second panel 16. The longitudinal side 18 of the first panel 14 is attached to the longitudinal side 26 of the second panel and the longitudinal side 20 of the first panel 14 is attached to the longitudinal side 28 of the second panel 16. Also, the second end 24 of the first panel 14 is attached to the second end 32 of the second panel 16. In a preferred embodiment, the panels are attached to one another by stitching, or other well-known nonremovable fastening means, so that they are permanently joined together during use. However, the first ends 22 and 30 of the first and second panels respectively, remain unattached defining an opening 34 into the case 12 for access into the compartment 36 between the first and second panels, 14 and 16 respectively.

Figure 7:
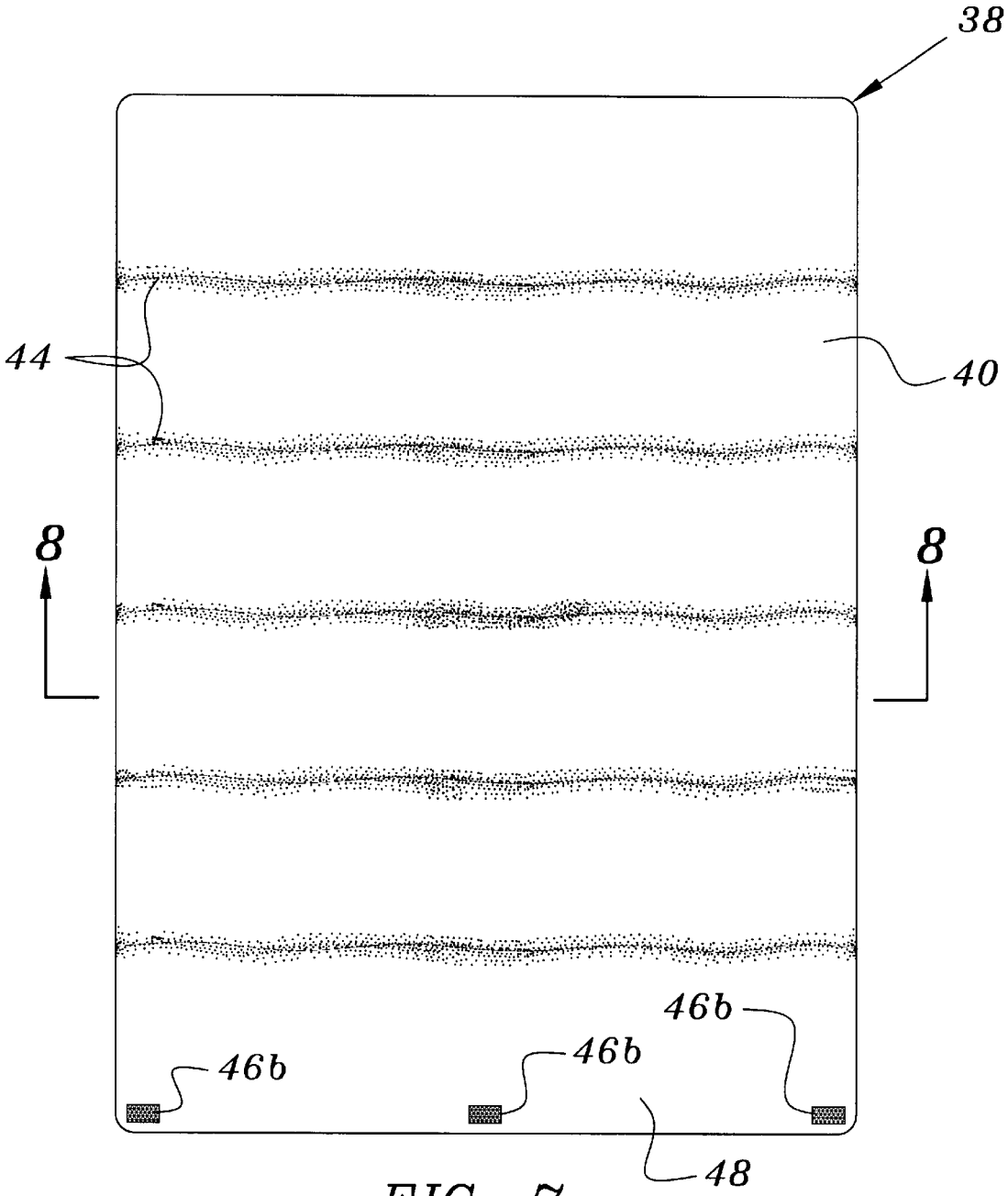
FIG. 7 is an unfolded bottom plan view of the insulating layer of the sleeping bag of FIG. 1.
Figure 8:
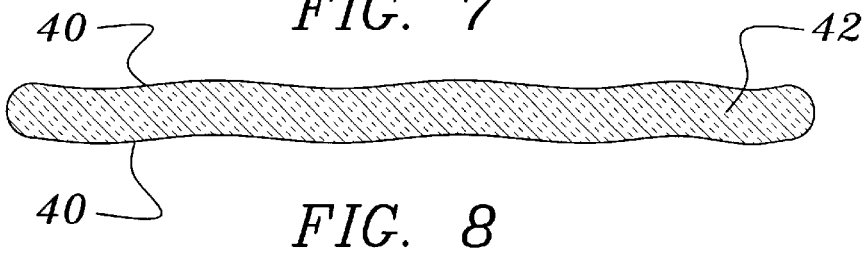
FIG. 8 is a cross-sectional view of the insulating layer taken along line 8—8 of FIG. 7.

An insulation layer 38, as seen in FIG. 7, is sized and configured to be receivable within and removal from the compartment 36 through the opening 34. The insulation layer 38 may be constructed in any well-known fashion, including sewing material 40 together to create a bag like structure to contain loose insulation material 42 or batting. The insulation layer 38 may be sewn along a plurality of lines 44, or may be quilted (not shown) to maintain the shape of the insulation layer 38 by reducing the migration of the insulation material 42. The insulation layer 38 may also be a layer of preformed bonded batting material, which is adequately bonded to prevent migration. In the alternative, the insulation layer 38 may be any other suitable insulating material, including but not limited to, a woven or unwoven sheet material.

At least one fastener 46 is used to attach the insulation layer 38 to the case 12 to prevent it from shifting within the case 12. As seen in FIG. 3 and FIG. 7, in a preferred embodiment, the fastener 46 comprises a two-part hook and loop fastener in which one part 46*a* is attached to the first panel 14 and a second part 46*b* is attached to the insulation layer 38. Also, in this preferred embodiment, there are three fasteners 46 arrayed proximal to the second end 24 of the first panel 14 and the second end 48 of the insulation layer 38. In other preferred embodiments, one-half of the fastener 46 may be located anywhere on the first panel 14 or on the second panel 16 with the other half on the adjacent area of the insulation layer 38. In other embodiments, the fastener 46 may comprise a snap, a hook and eye or any other well-known attaching means that would be suitable for the purpose.

In a preferred embodiment, the opening 34, may be closed by at least one hook and loop fastener 50, with the first part 50*a* of the fastener 50 being attached proximal the first end 22 of the first panel 14 and the second part 50*b* of the fastener 50 being attached proximal the second end 30 of the second panel 16. As seen in FIG. 3, in a preferred embodiment three fasteners 50 are used. In other embodiments, the opening 34 may be closed by a zipper, snaps or other suitable means.

The longitudinally extending sides of the first and second panels, 14 and 16 respectively, define the longitudinally extending sides of the case 12, and the second ends of the first and second panels define the second end of the case 12. To form the sleeping bag 10, the case 12 is folded along the longitudinal centerline A, shown in FIG. 3 so that the longitudinal sides of the case 12 are juxtaposed as seen in FIG. 2. The second end of the case may be divided into a first portion on one side of the longitudinal centerline and a second portion on the other side of the longitudinal centerline A, so that when the case 12 is folded upon itself the first portion and the second portion of the second end are juxtaposed. The longitudinal sides of the case 12 are releasably attachable to one another and the first portion and the second portion of the second end of the case 12 are releasably attachable to one another. In a preferred embodiment, they are releasably attached to one another by a single zipper 52, which extends from the point at which the centerline crosses the second end of the case 12 to a point along the longitudinal sides proximal the first end of the case 12. In other preferred embodiments, hook and loop fasteners, snaps, or other suitable fastening means, may be used in place of the zipper 52 to close the sleeping bag 10.

Figure 5:
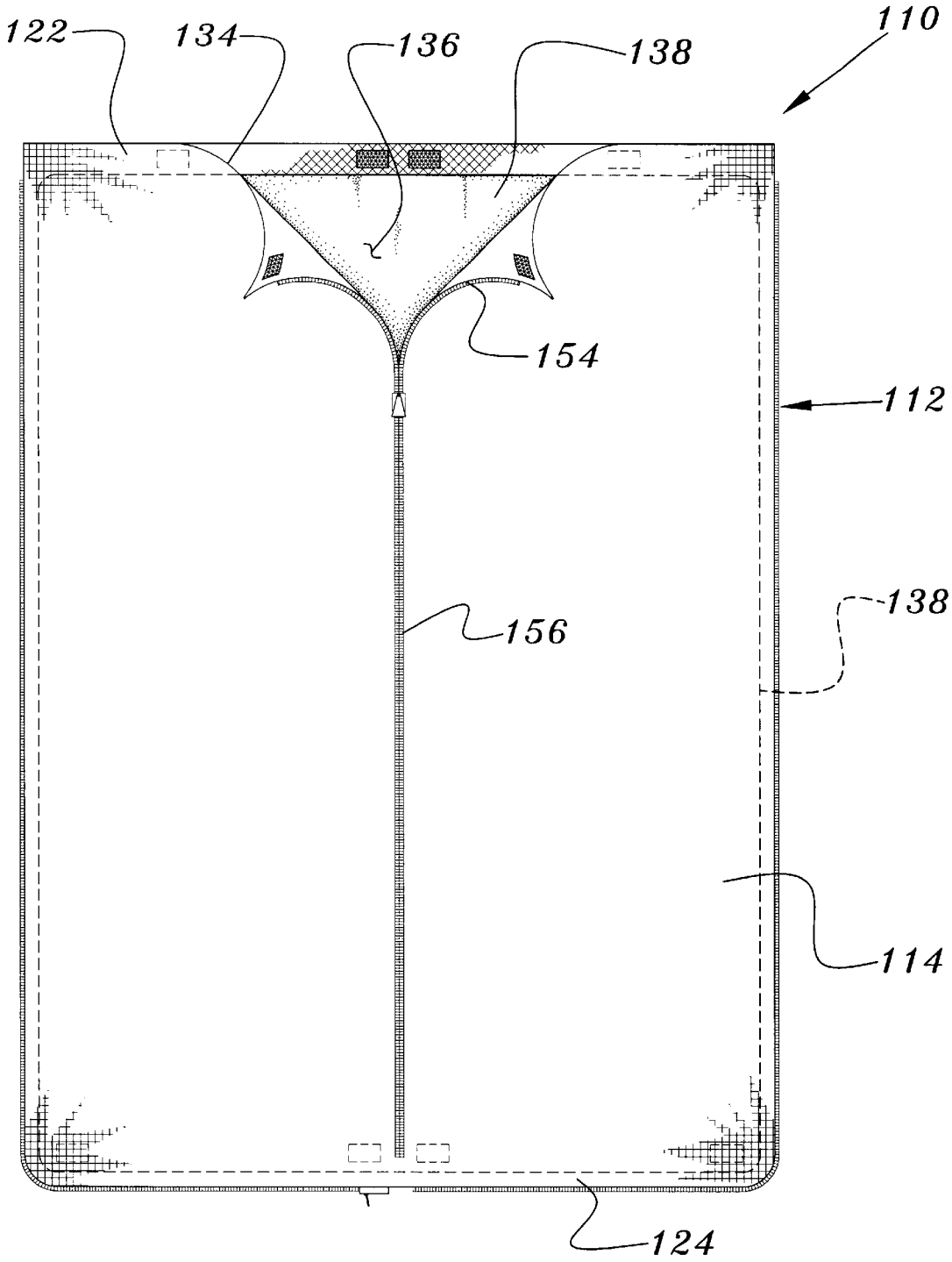
FIG. 5 is an unfolded bottom plan view of a second embodiment of the sleeping bag of FIG. 1

FIG. 5 illustrates a second embodiment 110 of the sleeping bag 10. The structure of the sleeping bag 110 is identical to the structure of the sleeping bag 10 with exception of a closeable opening 154 that extends inwardly (in relation to the case) from one end of the case 112 toward the other end of the case 112. In a preferred embodiment, the opening 154 extends from the first end 122 of the first panel 14 to a point that is proximal to the second end 124 of the first panel 114. In addition, in this preferred embodiment, the opening extends generally along the longitudinal centerline A. The opening 154 expands the opening 134, permitting easier insertion of the insulation layer 138 through the expanded opening (comprising the opening 134 and the opening 154) into the compartment 136. The opening 154 is openable and closeable by a zipper 156. In other preferred embodiments, snaps and hook and loop fasteners may be used in place of the zipper 156.

Figure 6:
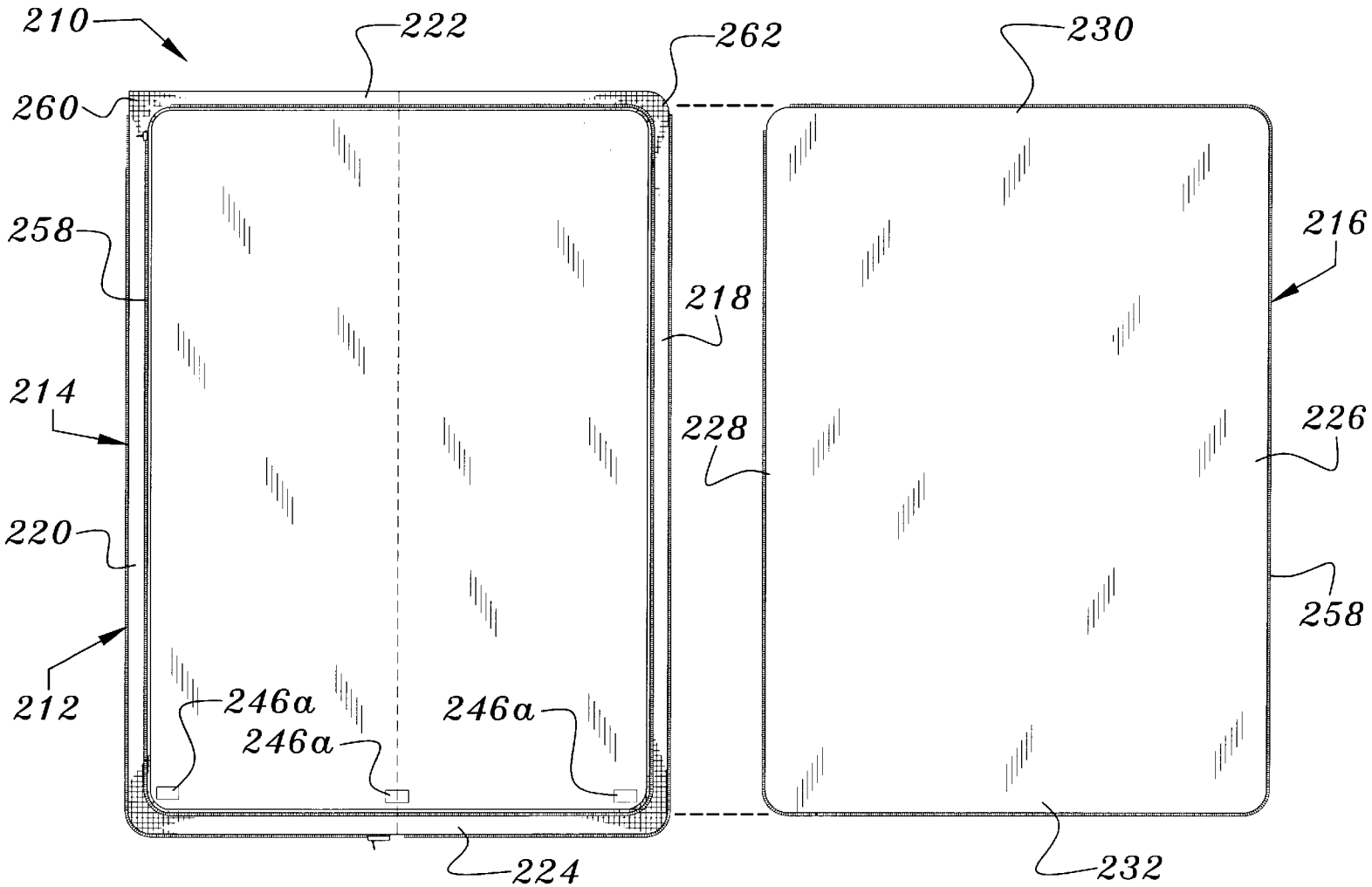
FIG. 6 is an unfolded top plan view of a third embodiment of the sleeping bag of this invention, illustrating the second panel removed from the first panel.

FIG. 6 illustrates a third embodiment 210 of the sleeping bag 10. In this embodiment, the first panel 214 is totally separable from the second panel 216, being releasably attachable to one another by a zipper 258. Therefore, the longitudinal sides 220 and 218 of the first panel 214 are attached to the respective longitudinal sides 228 and 226 of the second panel 216, and the second end 224 of the first panel 214 is attached to the second end 232 of the second panel 216. In this embodiment, the zipper 258 also joins the first end 222 of the first panel 214 to the first end 230 of the second panel 216. The zipper 258 is attached so that it extends from the comer 260 of the first panel 214 along the longitudinal side 220, across the second end 224, along the second longitudinal side 218 and then back along the first end 222 to the corner 260. This particular positioning of the zipper is to permit opening the first end of the case 212, while leaving the longitudinal sides and the second end of the case 212 attached to one another. This will permit easy insertion of a back board, air mattress or pillow material. In other embodiments the zipper 258 may end at the corner 260, leaving the first end of the case 212 open. As in the first embodiment of the sleeping bag 10, the first end may then be closed by snaps or hook and loop fasteners.

The sleeping bag 10 may be constructed from many different materials, providing choices to the consumer. The first and second panels 14 and 16 respectively, may be constructed of various weights of nylon, with 70 denier nylon being a preferred weight for general usage. The panels may also be constructed from nylon tricot, cotton duck, cotton poplin and cotton tricot. Since the first panel comprises the exterior surface or shell of the sleeping bag 10 and the second panel the inner liner, which is in contact with the consumer, a preferred combination of materials may comprise constructing the first panel from 70 denier rip-stop nylon for lightness and wear and constructing the second panel from cotton tricot for comfort. The consumer will also have choices of color, for example, plain colors like green or red, camouflage colors of green or tan, or attractive designs and patterns.

The insulation layer 38 may be constructed from various weights of materials that are well-known for their insulation capabilities. In a preferred embodiment the insulation layer 38 is constructed from a batt of polyester fiber which is enclosed in an interfacing cover. The interfacing cover may be a woven or non-woven fabric made from cotton, or various synthetic fibers. The batts may be constructed of various weights, such as, but not limited to, two , three or four pound batts.

Having thus set forth a preferred construction for the current invention, it is to be remembered that this is but a preferred embodiment. Attention is now invited to a description of the use of the sleeping bag 10. The consumer will select a case 12 that is constructed from the particular materials or combination of materials or colors that the consumer finds desirable for the planned usage of the sleeping bag 10. The consumer may elect to purchase several different cases 12 with different materials and colors. The consumer will also select one or more appropriate insulation layers 38 having different insulation factors needed to provide the necessary warmth for various planned uses.

Now, prior to the use of the sleeping bag 10, the consumer will select the appropriate case 12 and the appropriate insulation layer 38 for the planned use. The consumer will then open the first end of the case 12 and insert the insulation layer 38. If the consumer purchases the case illustrated as embodiment 112, as illustrated in FIG. 5, the consumer may then open zipper 156 to expand the opening in the case 112, thereby easing the installation of the insulation layer 38. The consumer will ensure that the first part of the fasteners 46*a* that are attached to the case 12 are joined to the second part of the fastener 46*b* that are attached to the insulation layer 38. This will restrict the movement of the insulation layer 38 within the case 12. The consumer will then re-fasten the fasteners 50 across the first end of the case 12 to keep case 12 closed about the insulation layer 38 and to prevent dirt from entering the case 12.

The consumer may now fold the bag along its longitudinal centerline A, thereby folding it upon itself so that the zipper 52, or other closure means, may be engaged attaching the longitudinal sides of the case to each other and the two portions of the second end of the case to each other. The sleeping bag 10 is now ready for use or to be packed for travel.

The third embodiment of sleeping bag 210 provides the consumer with many additional choices. The first panel 214 and the second panel 216 may now be sold separately so the consumer may construct a case 212 by selecting from many different. For example, if there were six different first panels 214, six different second panels 216 and 10 different insulation layers 38, the consumer could construct 360 different sleeping bags.

In addition to the ability to construct a custom sleeping bag, the consumer can disassemble the sleeping bag for cleaning purposes. This enables the consumer to use different cleaning techniques on the different parts and to clean only that part which is soiled.

While the foregoing describes several particularly preferred embodiments of the present invention, it is to be understood that numerous variations and modifications of the structure will occur to those skilled in the art. Accordingly, the foregoing description is to be considered illustrative only of the principles of this invention and is not to be considered limitative thereof, the scope of the invention being determined solely by the claims appended hereto.

What is claimed is:

1. A sleeping bag comprising:

a case comprising;

a first panel having a pair of longitudinally extending sides, a first end and a second end, a second panel having a pair of longitudinally extending sides, a first end and a second end, said second end of said second panel being attached to said second end of said first panel, said longitudinal sides of said second panel being attached to the adjacent said longitudinal sides of said first panel creating a compartment therebetween, and said first ends of said first and second panels defining an opening in said case for access into said compartment;

an insulation layer, sized and configured to be receivable within and removable from said compartment through said opening in said case, at least one fastener attaching said insulating layer to said case, and said adjacent longitudinal sides of said first and second panels defining the longitudinal sides of said case, said first ends of said first and second panels defining said first end of said case, and said second ends of said first and second panels defining said second end of said case, said first end of said case, comprising a first portion and a second portion, said case being longitudinaly folded upon itself such that said longitudinal sides of said case are juxtaposed and said first portion and said second portion of said first end of said case are juxtaposed, said longitudinal sides of said case being releasably attachable to one another and said two portions of said second end of said case being releasably attachable to one another, said first panel including a closeable opening proximal the longitudinal center line of said first panel, extending inwardly from said first end of said first panel toward said second end of said first panel, such that said insulating layer may be more easily inserted in said compartment.

2. A sleeping bag as in claim 1 wherein said first panel is releasably attachable and thereby fully separable from said second panel.

3. A sleeping bag as in claim 1 wherein said first end of said second panel is releasably attachable to said first end of said first panel.

4. A sleeping bag as in claim 1 wherein said insulating layer has a second end, and said at least one fastener comprises a first part and a second part and said first part being attached to said first panel proximal said second end of said first panel and said second part is attached to said insulating layer proximal said second end of said insulating layer.

5. A sleeping bag as in claim 1 wherein said first panel is attached to said second panel by stitching.

6. A sleeping bag comprising:

a case comprising;

a first panel having a pair of longitudinally extending sides, a first end and a second end, a second panel having a pair of longitudinally extending sides, a first end and a second end, said second end of said second panel being attached to said second end of said first panel, said longitudinal sides of said second panel being attached to the corresponding said longitudinal sides of said first panel creating a compartment therebetween, and said first ends of said first and second panels defining an opening in said case for access into said compartment;

an insulation layer, sized and configured to be receivable within and removable from said compartment through said opening in said case, a closeable opening extending inwardly from one end of said case toward said other end of said case, whereby said insulating layer may be more easily inserted in said case; and said adjacent longitudinal sides of said first and second panels defining the longitudinal sides of said case, said first ends of said first and second panels defining said first end of said case, and said second ends of said first and second panels defining said second end of said case, said first end of said case, comprising a first portion and a second portion, said case being longitudinally folded upon itself such that said longitudinal sides of said case are juxtaposed and said first portion and said second portion of said first end of said case are juxtaposed, said longitudinal sides of said case being releasably attachable to one another and said two portions of said second end of said case being releasably attachable to one another.

* * * * *

UNITED STATES PATENT AND TRADEMARK OFFICE

CERTIFICATE OF CORRECTION

PATENT NO. : 6,338,173 B1
DATED : January 15, 2002
INVENTOR(S) : Ramsey, Carson A.

It is certified that error appears in the above-identified patent and that said Letters Patent is hereby corrected as shown below:

Column 8,
Line 8, after "another" insert:
-- , said first panel including a closeable opening proximal the longitudinal center line of said first panel, extending inwardly from said first end of said first panel toward said second end of said first panel, such that said insulating layer may be more easily inserted in said compartment. --

Signed and Sealed this

Twenty-seventh Day of August, 2002

*Attest:*

*Attesting Officer*

JAMES E. ROGAN
*Director of the United States Patent and Trademark Office*